US011454019B1

(12) United States Patent
Hussain

(10) Patent No.: US 11,454,019 B1
(45) Date of Patent: Sep. 27, 2022

(54) INFLATABLE HABITAT FOR PERMANENT HUMAN SETTLEMENT

(71) Applicant: MAREEKH DESIGN PTY LTD., Smithfield (AU)

(72) Inventor: Muhammad Akbar Hussain, Smithfield (AU)

(73) Assignee: MAREEKH DESIGN PTY LTD., Smithfield (AU)

( * ) Notice: Subject to any disclaimer, the term of this patent is extended or adjusted under 35 U.S.C. 154(b) by 0 days.

(21) Appl. No.: 17/695,686

(22) Filed: Mar. 15, 2022

Related U.S. Application Data

(63) Continuation-in-part of application No. 29/781,163, filed on Apr. 28, 2021.
(Continued)

(51) Int. Cl.
*E04B 1/32* (2006.01)
*E04B 1/34* (2006.01)
(Continued)

(52) U.S. Cl.
CPC ..... *E04B 1/3211* (2013.01); *E04B 1/34* (2013.01); *E04B 1/92* (2013.01);
(Continued)

(58) Field of Classification Search
CPC . E04B 1/3211; E04B 1/34; E04B 1/92; E04B 2001/0061; E04B 2001/3252; E04B 2001/3294; E04B 2001/925
See application file for complete search history.

(56) References Cited

U.S. PATENT DOCUMENTS 5,101,605 A * 4/1992 Masuyama ..... E04B 1/3211 52/64
5,560,151 A * 10/1996 Roberts ..... E04B 1/3211 52/249
(Continued)

FOREIGN PATENT DOCUMENTS

DE 4411491 A1 * 10/1995 ..... E04B 1/169
WO WO-9316259 A1 * 8/1993 ..... B09B 1/00

OTHER PUBLICATIONS

Kennedy, Kriss et al., Inflatable Structures Technology Handbook, NASA, Jul. 5, 2020.
(Continued)

*Primary Examiner* — Babajide A Demuren

(57) ABSTRACT

An inflatable habitat using inflatable structures and necessary accessories offers secure permanent human settlement in an environment such as Mars with an air pressure below the earth's atmospheric pressure. Built upon a crater, the inflatable structure comprises various resilient multilayer roof segments integrated with segment frames to contain extreme internal inflation pressures to provide habitability, maintenance of thermal environment, and low-cost manufacturability using local resources. The roof of the inflatable structure is firmly secured along a rim and a floor of the crater through a wall anchor system and a dual internal roof anchor system to provide a durable structure against hostile weather conditions. A "smart design" using the wall anchor system allows the installation of an outer roof in parallel to the existing roof. Further, a magnetic radiation shield generated through roof power elements externally encloses the roof to facilitate optimal active protection against solar and/or cosmic radiations.

20 Claims, 13 Drawing Sheets

Related U.S. Application Data

(60) Provisional application No. 63/161,035, filed on Mar. 15, 2021.

(51) Int. Cl.
*E04B 1/92* (2006.01)
*E04B 1/00* (2006.01)

(52) U.S. Cl.
CPC ..... *E04B 2001/0061* (2013.01); *E04B 2001/3252* (2013.01); *E04B 2001/3294* (2013.01); *E04B 2001/925* (2013.01)

(56) References Cited

U.S. PATENT DOCUMENTS 6,439,508 B1 8/2002 Taylor
7,469,864 B2 12/2008 Bigelow
8,070,105 B2 12/2011 Johnson et al.
8,474,760 B2 7/2013 Leventhal
9,970,208 B2 5/2018 Irons
2006/0059788 A1* 3/2006 Kassianoff ..... E04B 1/74 52/2.11
2014/0137484 A1* 5/2014 Purdy ..... B32B 1/08 52/2.18

OTHER PUBLICATIONS

Slough, John, Spacecraft Scale Magnetospheric Protection from Galactic Cosmic Radiation, NASA, Aug. 2, 2019 <URL: https://www.nasa.gov/directorates/spacetech/niac/2018_Phase_I_Phase_II/Spacecraft_Scale_Magnetospheric_Protection_from_Galactic_Cosmic_Radiation/>.

* cited by examiner

INFLATABLE HABITAT FOR PERMANENT HUMAN SETTLEMENT

The current application claims a priority to the U.S. Provisional Patent application Ser. No. 63/161,035 filed on Mar. 15, 2021 and a priority to the U.S. Design patent application Ser. No. 29/781,163 filed on Apr. 28, 2021.

FIELD OF THE INVENTION

The present invention relates generally to building structures and construction elements for human habitation. More specifically, the present invention relates to an inflatable habitat for permanent human settlement in an environment with a gas pressure below the earth's atmospheric pressure.

BACKGROUND OF THE INVENTION

Mars and other planets are calling and we are heeding it. Before embarking on humanity's next giant leap, the creation of a viable engineering solution for permanent human settlement on Mars is required which not only demands a radical engineering approach suited to the unique Martian context, but also such a proposal must fall within the realm of current technology applicable both on Earth and Mars.

Further, current designs of inflatable habitat structures on Mars either offer small, cramped volumes for human habitation inside a miniature dome, cylindrical or toroid structures unsuitable for long-term or permanent human habitation, or impractically huge structures spanning several kilometers with no details of the engineering solutions for creation or maintenance of such structures against immense pressure difference between internal and external environments. Further, current inflatable habitat structures have small pressurized volumes insufficient for long-term human missions to Mars or its colonization where a shirt-sleeve environment with freedom of movement is not only essential for the mental well-being of the occupants but also necessary for logistical purposes. Additionally, current inflatable habitat structures do not eliminate the need for a heavy radiation shield of water or regolith directly above the habitats. Furthermore, current inflatable habitat structures do not facilitate efficient replacement of roofs of the structures for the inflatable habitat.

Therefore, there is a need for improved inflatable habitat with new technologies for permanent human settlement that may overcome one or more of the above-mentioned problems and/or limitations.

SUMMARY OF THE INVENTION

The present invention provides an innovative and unique technology, an inflatable structure also named "Craterhab", to facilitate permanent human settlement in an environment such as Mars and any other planet with a gas or air pressure below the earth's atmospheric pressure. Through an extensive use of the technology, an inflatable habitat with the inflatable structures and any necessary plants, equipment, systems, and accessories can be efficiently and effectively established using substantial local resources such as craters.

The inflatable habitation structure of the inflatable habitat of the present invention comprises offer a resilient multi-layer roof segments integrated with substantially strong segment frames to contain extreme inflation pressures relative to significantly low and/or vacuum atmosphere of the planet environment to provide habitability, maintenance of internal thermal environment, protection from radiation, easy repairability, ease of replacing, provision of ambient daytime light for creation of greenhouses, and low-cost manufacturability with much of manufacture possible using local resources. The Craterhab inflatable structures may be primarily built upon existing craters of a specific environment and provides enormous volumes of space and interconnections through underground and overground tunnel systems that interconnect the Craterhab inflatable structures of the inflatable habitat. Additionally, the roof of the Craterhab inflatable structure may be firmly secured along the rim and the floor of the crater through a wall anchor system and a dual internal roof anchor system to provide a safe, reliable, durable, and flexible structure to the internal living space against any significantly hostile weather conditions. Using gas turbines and/or air compressors, the Craterhab inflatable structures can be inflated and maintained with suitable air for efficient and effective human dwelling.

With an anchor mechanism necessary for a backup roof provided in the existing wall anchor system, a second roof for the Craterhab inflatable structure can be easily installed. This provision offers a "smart design" that allows the installation of an outer roof in parallel to the existing roof without evacuating the residents and infrastructure inside the Craterhab inflatable structure. Additionally, with an outer roof being built for the ensuing replacement, maintenance, and/or repair of the existing roof due to damages, aging, wear and tear, etc., the interior living environment of the Craterhab inflatable structure is maintained to avoid any disruption of internal activities.

Further, the Craterhab inflatable structure of the present invention comprises a magnetic radiation shield externally enclosing the roof. Supplying a suitable electrical DC (direct current) power to power cables integrated on the roof, a magnetic field can be generated to facilitate optimal active protection against solar and/or cosmic radiations to the interior space of the Craterhab inflatable structure.

DETAIL DESCRIPTIONS OF THE INVENTION

Figure 1:
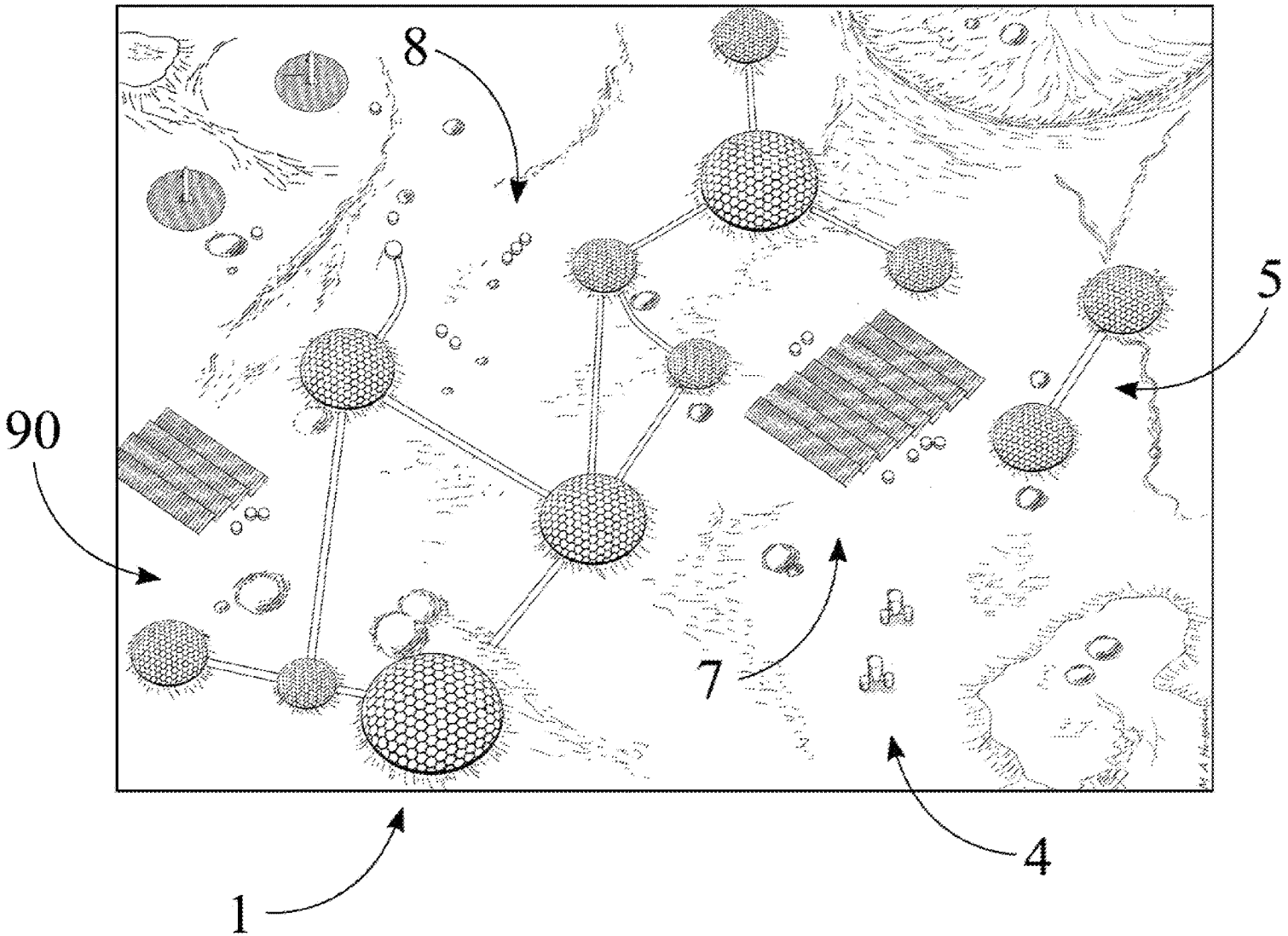
FIG. 1 is a top perspective view of an inflatable habitat of the present invention.

All illustrations of the drawings are for the purpose of describing selected versions of the present invention and are not intended to limit the scope of the present invention.

The present invention provides an inflatable habitat for human settlement in an environment with a gas or air pressure below the earth's atmospheric pressure. Such an environment includes, but is not limited to Mars, earth's moon, and any other planetary bodies. The inflatable habitat of the present invention comprises at least one inflatable habitation structure, named "Craterhab", which offers a resilient multilayer roof segments integrated with substantially strong segment frames to contain extreme inflation pressures relative to significantly low and/or vacuum atmosphere to provide habitability, maintenance of internal thermal environment, protection from radiation, easy repairability, ease of replacing, provision of ambient daytime light for creation of greenhouses, and low-cost manufacturability within the existing technology, with much of manufacture possible using local resources. The Craterhab inflatable structures of the present invention may be primarily built upon existing craters of a specific environment and provides enormous volumes of space and interconnections through underground and overground tunnel systems. Additionally, the roof of the Craterhab inflatable structure may be firmly secured along the rim and the floor of the crater, and inflated with suitable air using gas turbines and/or air compressors for efficient and effective human dwelling.

As can be seen in FIG. 1 to FIG. 13, the inflatable habitat of the present invention comprises at least one inflatable structure 1. More specifically, the inflatable structure 1 comprises a crater 90, a roof 10, a wall 50, and a wall anchor system 70. The crater 90 comprises a rim 91, a floor 92, an opening 93, and a plurality of internal anchors 94. The rim 91 is peripherally positioned on the opening 93. The floor 02 is positioned on the bottom of the rim 91 opposite the opening 93. Additionally, the plurality of internal anchors 94 is interiorly mounted into the floor 92. Situated on top of the inflatable structure 1, the roof 10 comprises a plurality of roof segments 11, a plurality of roof skeletal frames 12, and a plurality of internal roof connectors 13. Specifically, the plurality of roof segments 11 is distributed across the roof 10 and each of the plurality of roof segments 11 is peripherally attached to at least one of the plurality of roof skeletal frames 12. Each of the plurality of internal roof connectors 13 is connected to at least one of the plurality of roof skeletal frames 12 and one of the plurality of internal anchors 94 of the crater 90. Additionally, the roof 10 is terminally and peripherally attached to the wall 50. Further, the wall anchor system 70 comprises a plurality of wall anchors 71 and the plurality of wall anchors 71 is distributed underground. Additionally, the plurality of wall anchors 71 is positioned beneath the rim 91 of the crater 90. The wall 50 is then mounted to the rim 91 and attached to the plurality of wall anchors 71 of the wall anchor system 70, as can be seen in FIG. 10.

As can be seen in FIG. 1 to FIG. 5 and FIG. 11 to FIG. 13, in the preferred embodiment of the present invention, the inflatable structure 1 comprises a shape including, but not limited to, a dome, oval, semi-sphere, etc.

Figure 11:
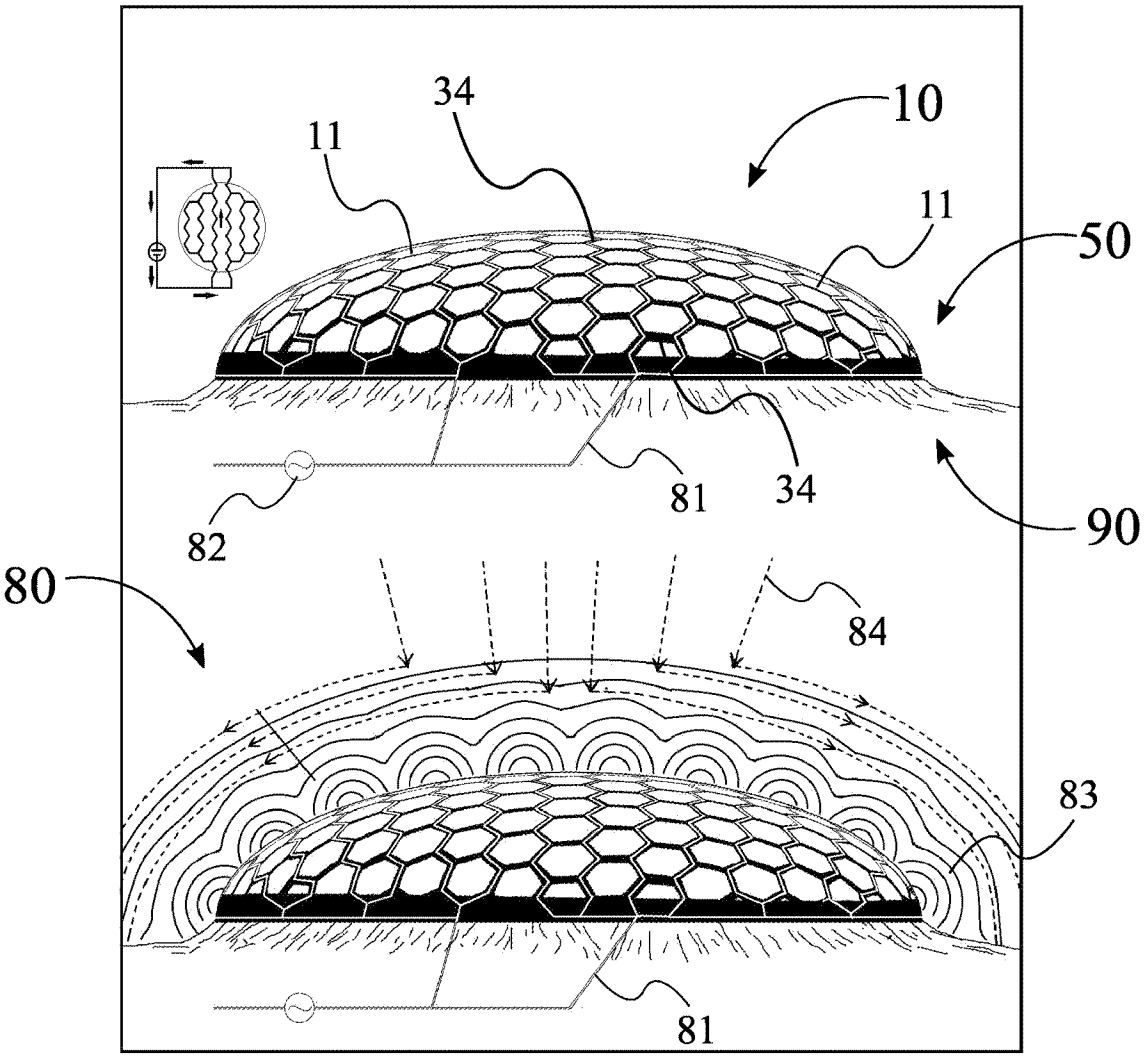
FIG. 11 is a front view of the inflatable structure of the present invention, wherein a diagram illustrates the electrical system for generating a magnetic radiation shield through a plurality of power cables on the roof.
Figure 12:
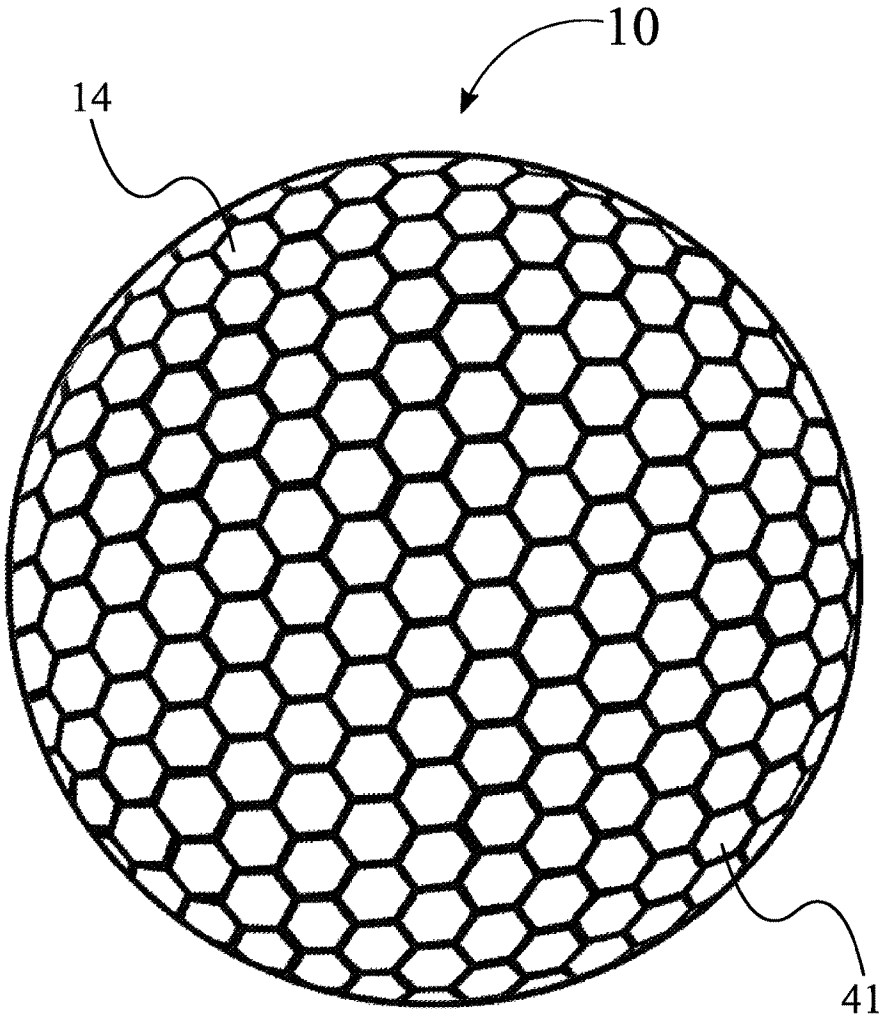
FIG. 12 is a top view of the roof of the present invention, wherein a hexagonal lattice roof pattern is illustrated.
Figure 13:
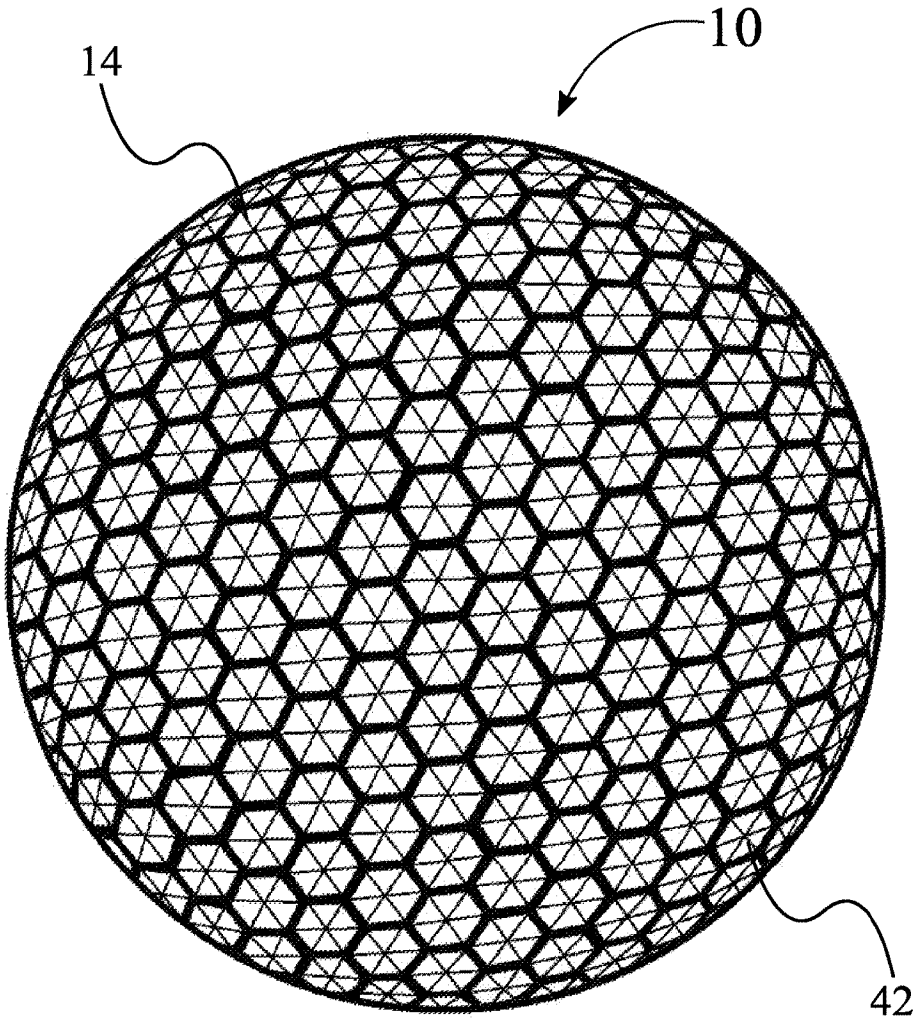
FIG. 13 is a top view of the roof of the present invention, wherein an isogrid lattice roof pattern is illustrated.

As can be seen in FIG. 11, the inflatable structure of the present invention comprises a magnetic shield system 80. The magnetic shield system 80 is externally positioned on the roof 10 and comprises a plurality of power cables 34. Each of the plurality of power cables 34 is interconnected with an arbitrary one thereof. The plurality of power cables is externally positioned on the roof; and wherein the plurality of power cables generates a magnetic field enclosing the exterior of the roof when a DC (direct current) electric power is supplied to the plurality of power cables. Additionally, the magnetic shield system 80 comprises a plurality of main power cables 81, and an AC (alternate current) to DC (direct current) power converter 82. The AC to DC power converter 82 is electrically connected with an extraneous power source through the plurality of main power cables 81. Additionally, each of the plurality of power cables 34 is positioned on one of the roof skeletal frames 12 of the roof 10. Further, the magnetic shield system 80 comprises a plurality of main power cables 81, and an AC (alternate current) to DC power converter 82. The AC to DC power converter 82 is electrically connected with an extraneous power source through one of the plurality of main power cables 81. The AC to DC power converter 82 is electrically connected with the plurality of power cables 34 of the roof skeletal frames 12 through one of the plurality of main power cables 81, wherein the magnetic field is generated by the plurality of power cables 34 with the DC flowing through thereof. The magnetic radiation shield 80, also named "Solar radiation through its Active Integrated Radiation Shield (AIRS)", of the inflatable structure facilitates optimal protection to the interior space of the inflatable structure 1. More specifically, using the plurality of power cables 81 of each of the roof skeletal frames 13 carrying a DC current power including, but not limited to, one kilowatt to hundreds kilowatts, the plurality of power cables 81 of the roof 10 generates a non-ionizing electromagnetic field matching Earth's magnetic field over the crater 90 with the opening 93 in a diameter, including, but not limited to, roughly 300 meters, sufficient enough to deflect a significant fraction of solar or cosmic radiation and thus protecting the habitable spaces.

Figure 7:
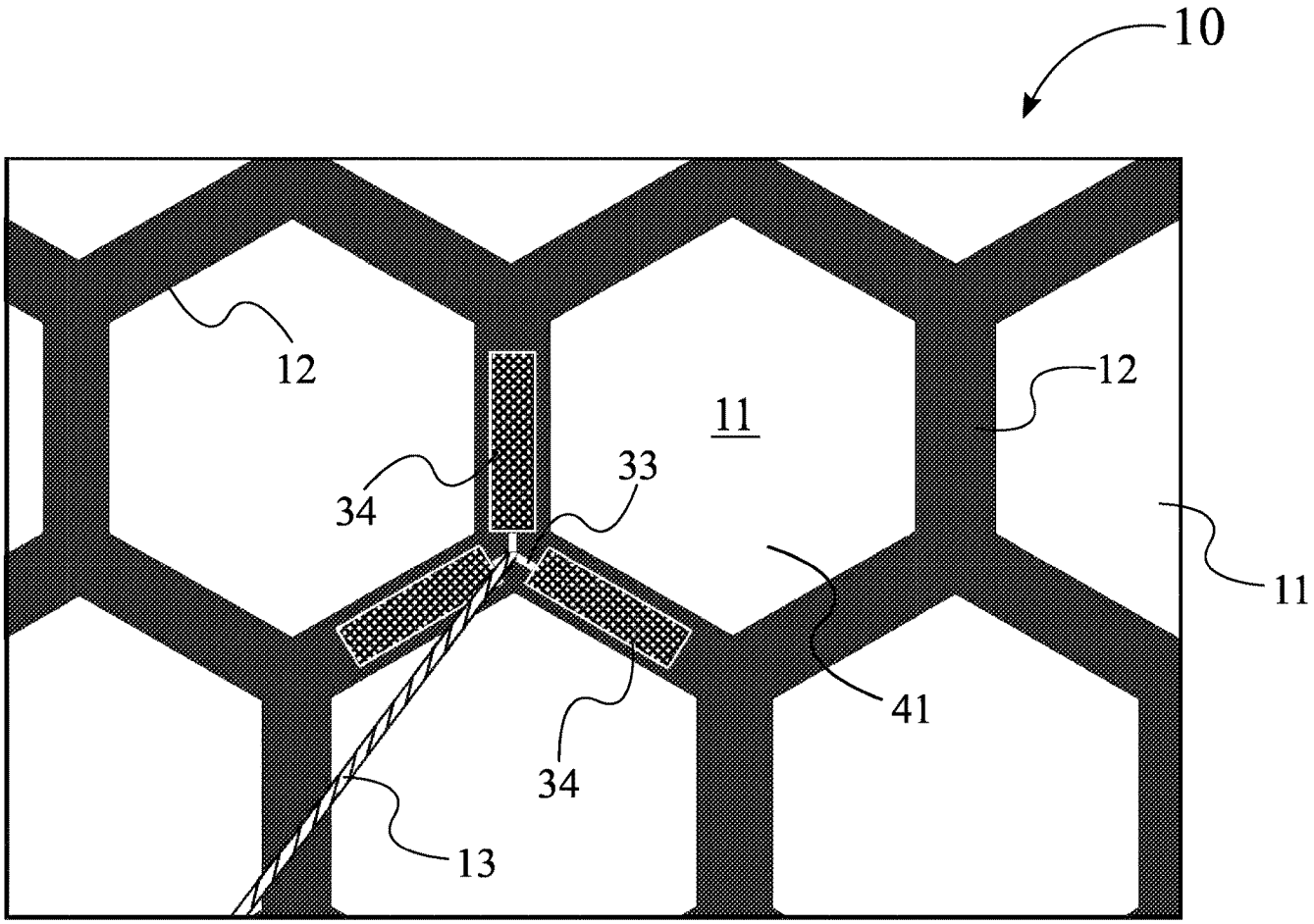
FIG. 7 is a bottom view of a roof of the present invention, wherein the roof segments and multiple roof skeletal frames form a substantial strong and flexible roof structure.
Figure 9:
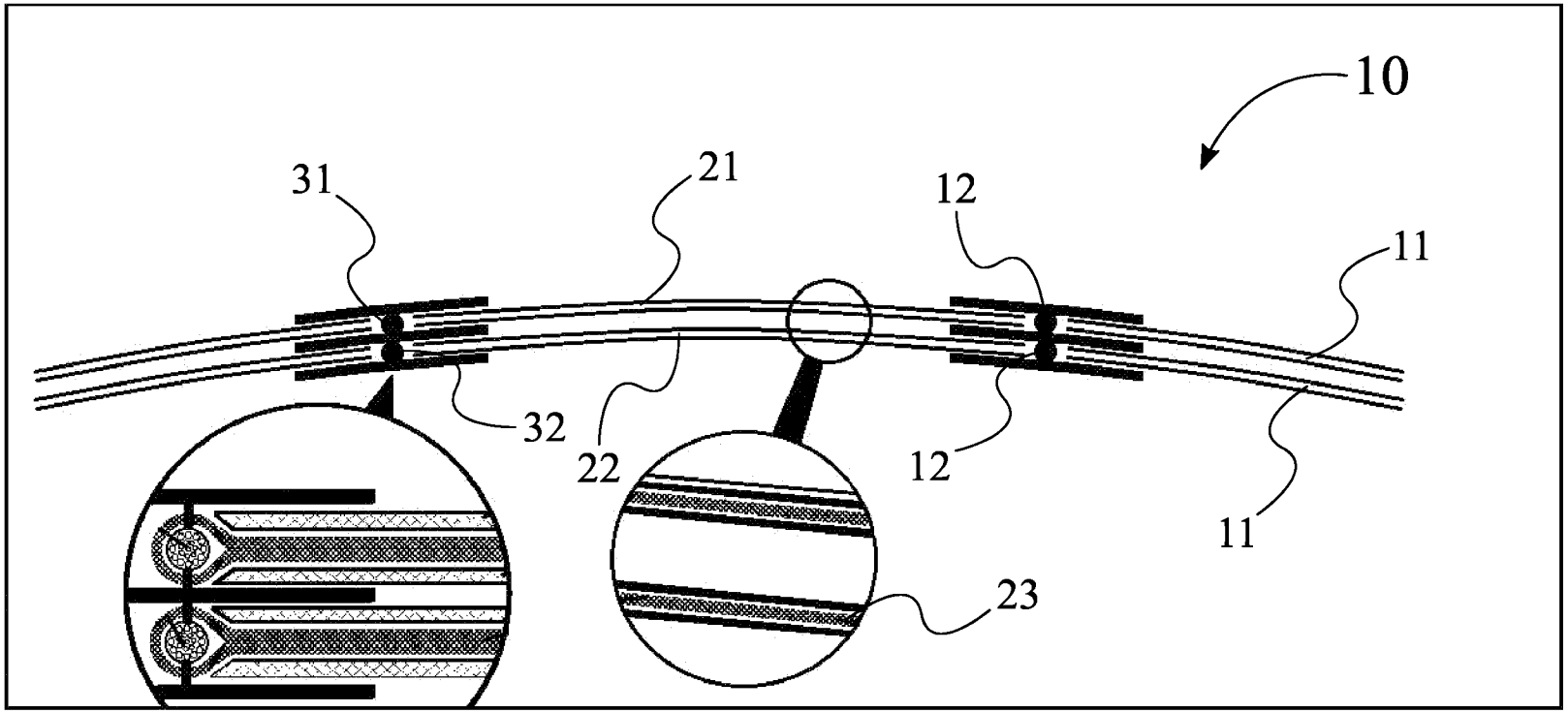
FIG. 9 is a frontal cross-section view of the roof of the present invention, wherein two enlarged views illustrate the detailed construction of the roof segments, the roof skeletal frames, and the connection between the roof segment and the roof skeletal frame.
Figure 10:
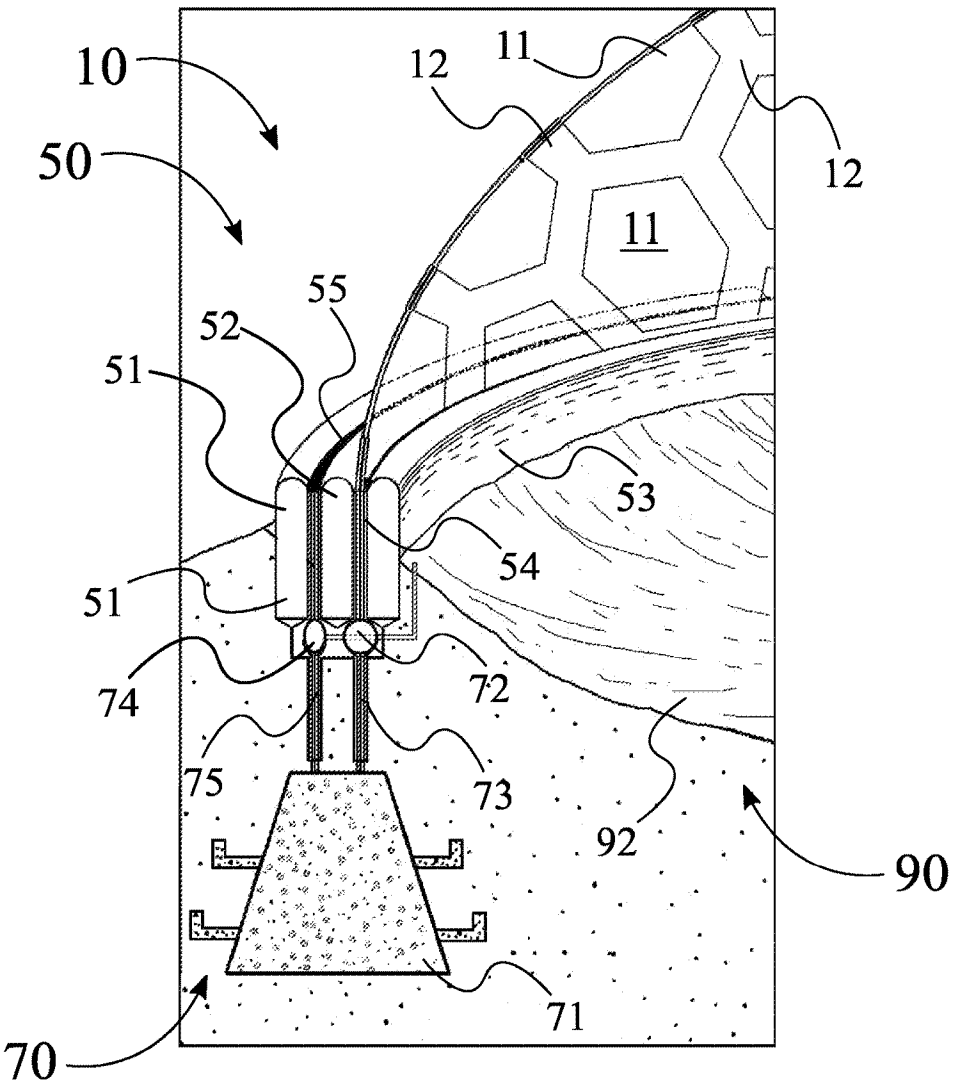
FIG. 10 is a frontal cross-section view of the roof, a wall, and a wall anchor system of the present invention, wherein the roof is attached to the wall and the wall anchor system which also provides efficient installation of a backup roof if desired.

As can be seen in FIG. 9, each of the plurality of roof segments 11 of the roof 10 comprises an upper segment 21 and a lower segment 22. Specifically, the lower segment 22 is positioned on the roof 10 facing the opening 93 of the crater 90. Additionally, the upper segment 21 is positioned on the roof 10 opposite the lower segment 22. Further, each of the plurality of roof skeletal frames 12 comprises an upper frame 31 and a lower frame 32. The upper segment 21 of each of the plurality of roof segments 11 is attached to the upper frame 31 of one of the plurality of roof skeletal frames 12. Additionally, the lower segment 22 of each of the plurality of roof segments 11 is attached to the lower frame 32 of one of the plurality of roof skeletal frames 12. As can be seen in FIG. 7, the lower frame 32 of the plurality of roof skeletal frames 12 comprises a roof anchor 33, and the roof anchor 33 is attached to one of the plurality of internal roof connectors 13.

As can be seen in FIG. 9, the upper segment 21 and the lower segment 22 each comprises a composite segment 23.

More specifically, the composite segment 23 comprises a first layer 25, a core layer 26, and a second layer 27. The second layer 27 is positioned on the plurality of roof segments 11 facing the opening 93 of the crater 90. The core layer 26 is attached to the second layer 27 opposite the opening 93 of the crater 90. Additionally, the first layer 25 is attached to the core layer 26 opposite the second layer 27. Thus, the core layer 26 is sandwiched between the first layer 25 and the second layer 27. Both the first layer and the second layer 27 may include, but are not limited to, silicone, composite material, such as Kevlar®, impregnated with carbon fiber, fiberglass, etc. The core layer 26 may include, but is not limited to, fabric, composite material, silicone composite fabric, etc. Thus, the composite segment 23 can provide super strength and enough translucency to let in sufficient sunlight. Further, the upper segment 21 comprises a protective layer 24. Specifically, the protective layer 24 is attached to the exterior surface of the upper segment 21 and the protective layer 24 includes, but is not limited to, a vacuum resistant layer, a vacuum resistant coating, etc. In the present invention, the protective layer 24 may be exposed to the low atmospheric pressure of the environment and protects the first layer 25, core layer 26, and the second layer 28 of the composite segment 23 from degradation, for example, degassing and/or moisture and gas content boiling off when exposed to vacuum.

Figure 8:
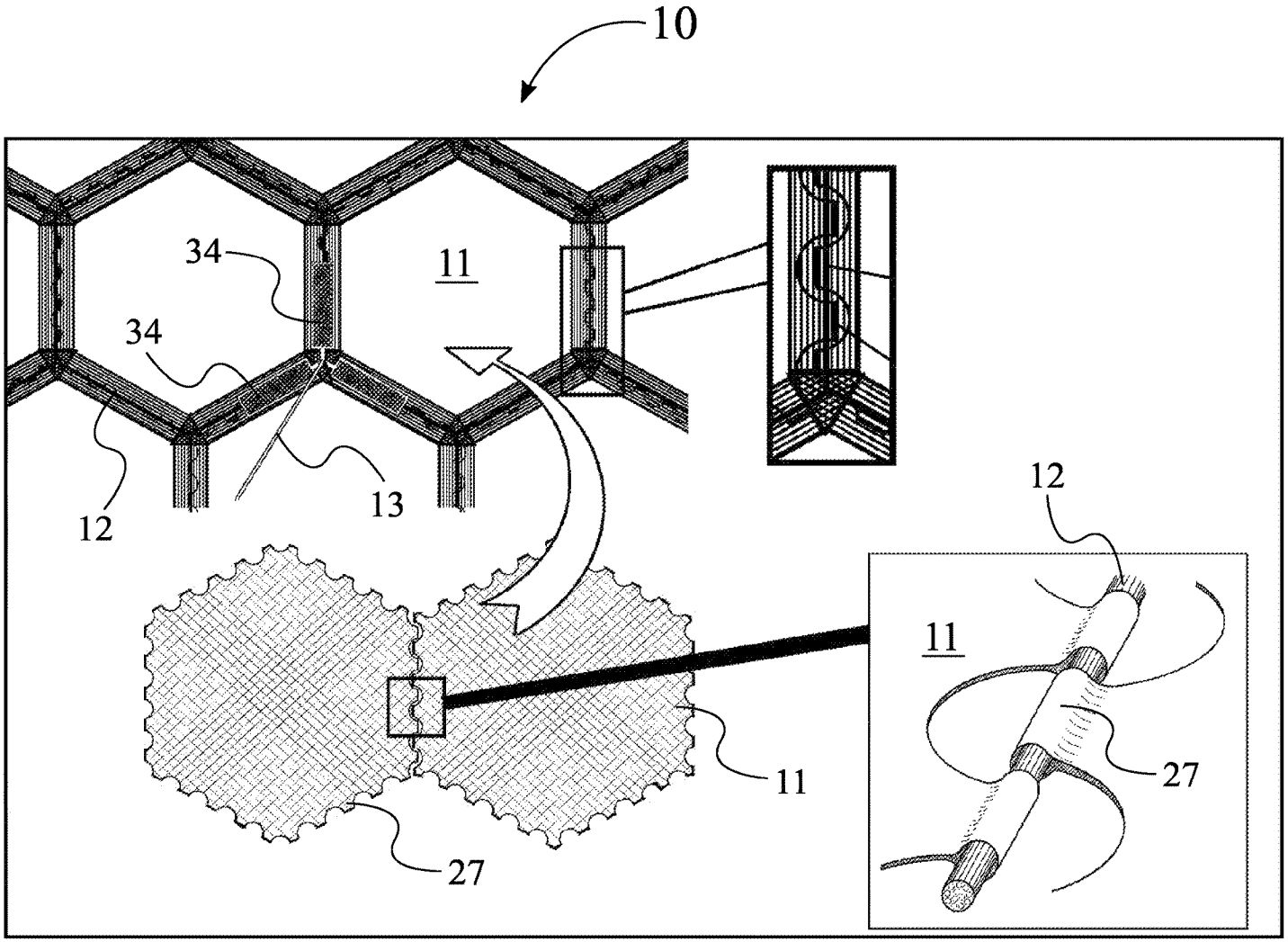
FIG. 8 is a top view of the roof of the present invention, wherein several enlarged views illustrate the roof segments, roof skeletal frames, and an exemplary connection between the roof segment and the roof skeletal frame.

As can be seen in FIG. 8, the composite segment 23 of the plurality of segments 11 comprises a plurality of interlocking tabs 27. The plurality of interlocking tabs 27 is terminally and peripherally distributed on the composite segment 23. Additionally, each of the plurality of interlocking tabs 27 is attached to one of the plurality of roof skeletal frames 12. The plurality of roof skeletal frames 12 may include, but not limited to, a substantial strong and lightweight material such as Dyneema® or Kevlar®. Being peripherally positioned on each of the plurality of roof segment 11, the plurality of roof skeletal frames 12 forms a skeletal fabric lattice. As can be seen in FIG. 7 to FIG. 8, and FIG. 11 to FIG. 13, in the preferred embodiment of the present invention, the plurality of roof segments 11 of the roof 10 is translucent. Additionally, each of the plurality of roof segments 11 comprises a form including, but not limited to, a repeating hexagonal lattice pattern, an isogrid lattice pattern, and any other suitable pattern, shape, etc.

Figure 5:
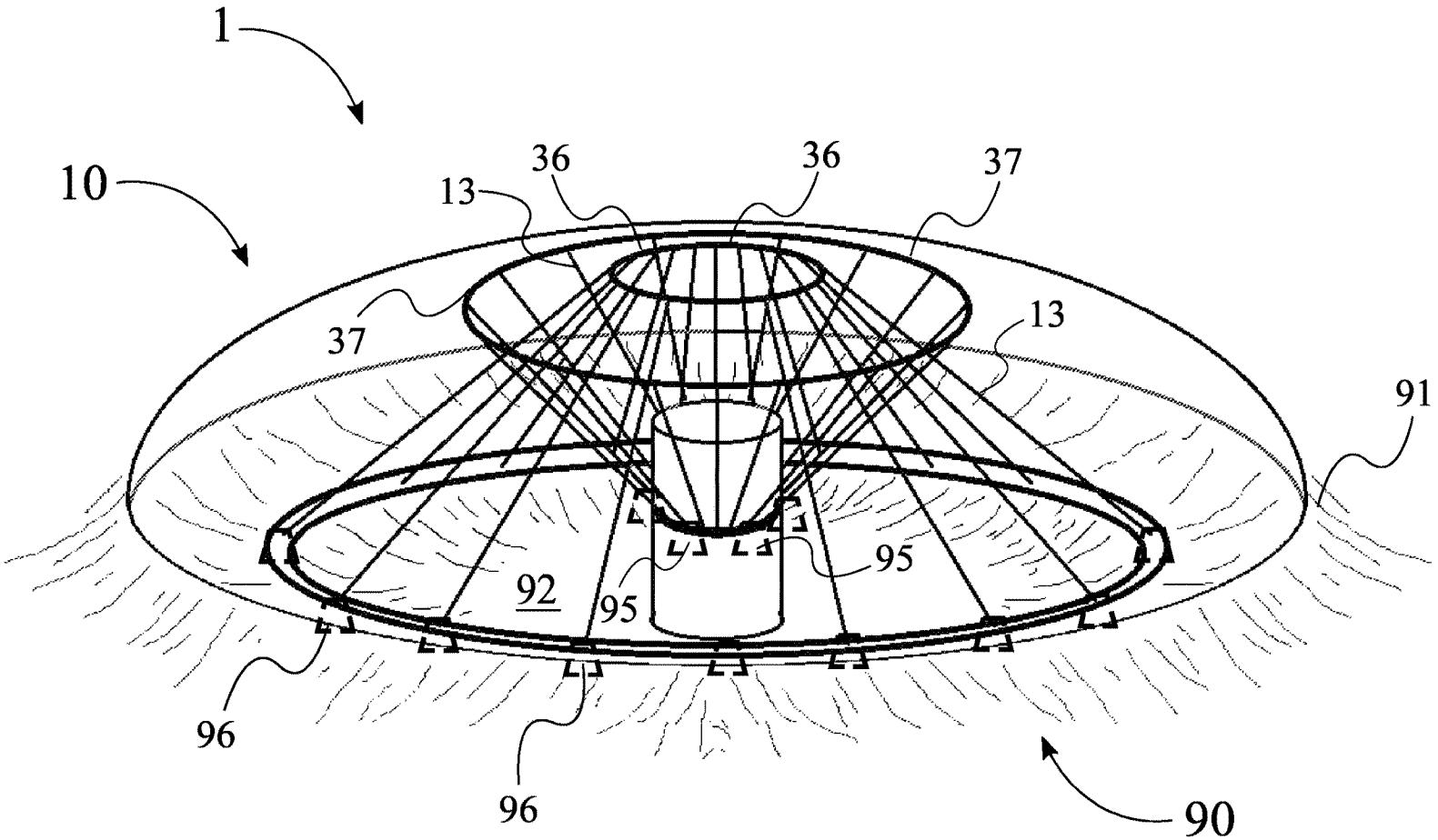
FIG. 5 is a front perspective view of a dual anchor system of the inflatable structure of the present invention.
Figure 6:
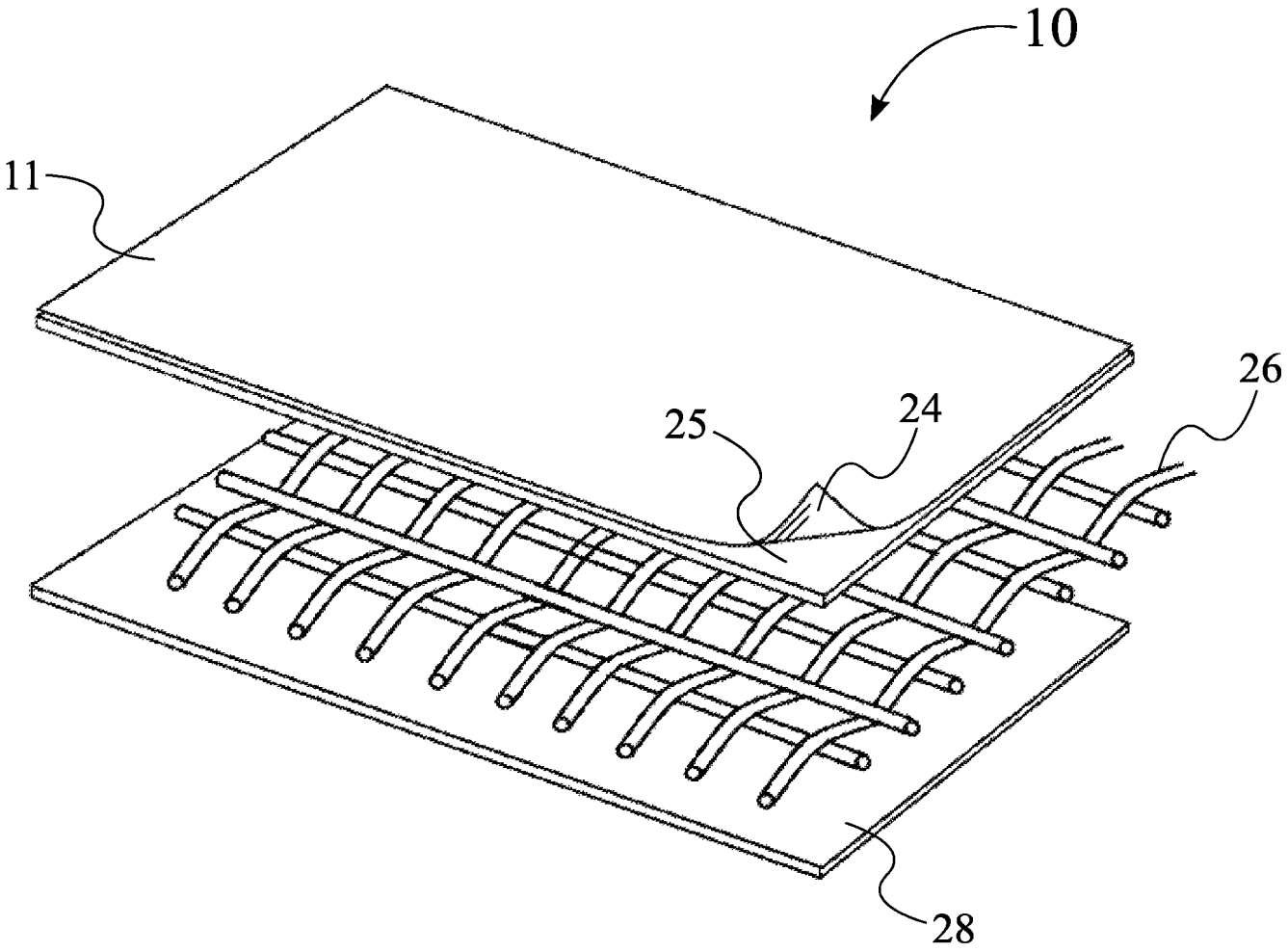
FIG. 6 is an exploded view of a roof segment of the present invention.

As can be seen in FIG. 5, the roof 10 of the inflatable structure 1 may be secured to the underground through a dual-fastening anchor system. More specifically, the plurality of internal anchors 94 of the crater 90 comprises a plurality of proximal anchors 95 and a plurality of distal anchors 96. Additionally, the plurality of distal anchors 96 is peripherally positioned inside the floor 92. The plurality of proximal anchors 95 is positioned inside the floor 92 adjacent the center of the floor 92. The plurality of roof skeletal frames 12 comprises a plurality of distal frames 37 and a plurality of proximal frames 36. The plurality of distal frames 37 is peripherally positioned on the roof 10. The plurality of proximal frames 36 is positioned on the roof 10 adjacent the center of the roof 10. Each of the plurality of proximal frames 36 of the plurality of roof skeletal frames 12 is connected to one of the plurality of distal anchors 96 of the plurality of internal anchors 94 through one of the plurality of internal roof connectors 13. Further, each of the plurality of distal frames 37 of the plurality of roof skeletal frames 12 is connected to one of the plurality of proximal anchors 95 of the plurality of internal anchors 94 through one of the plurality of internal roof connectors 12. The dual-radial internal anchor system secures the inflatable structure 1 to a set of underground concrete anchors beneath the floor 92 of the crater 90 and not only provides additional internal support to the main body of inflatable structure 1, but also minimizes lateral movement of inflatable structure 1 in the event of dust storms on the specific plant such as Mars.

Figure 4:
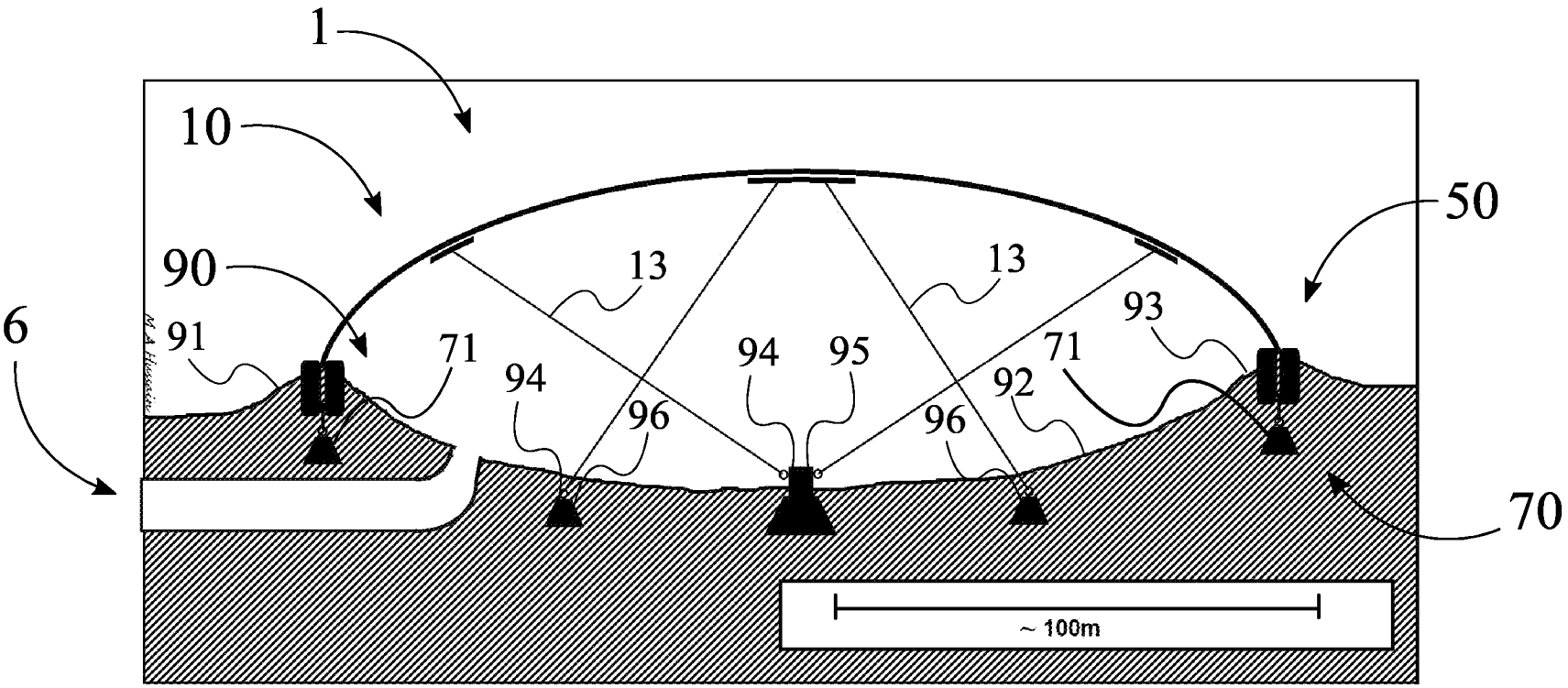
FIG. 4 is a frontal cross-section view of the inflatable structure of the present invention.

As can be seen in FIG. 4 and FIG. 10, the wall 50 comprises an outer wall 51, a middle wall 52, an inner wall 53, a first gap 54, and a second gap 55. More specifically, the inner wall 53 is mounted to the rim 91 of the crater 90 and is peripherally positioned on the opening 93 of the crater 90. The middle wall 52 is also mounted to the rim 92 of the crater 90 opposite the opening 93. The outer wall 51 is mounted to the rim 91 of the crater 90 adjacent the middle wall 52. Additionally, the first gap 54 is positioned between the inner wall 53 and the middle wall 52, and the second gap 55 is positioned between the middle wall 52 and the outer wall 51.

As can be seen in FIG. 10, the wall anchor system 70 comprises an inner inflatable anchor 72, and a plurality of inner anchor connectors 73. Specifically, the inner inflatable anchor 72 is within the rim 91 of the crater 90 and is terminally and peripherally positioned on the first gap 54 of the wall 50. The bottom of the roof 10 traverses through the first gap 54 of the wall 50, resulting in the roof 10 being terminally and peripherally attached to the inner inflatable anchor 72. Additionally, each of the plurality of inner anchor connectors 73 connects the inner inflatable anchor 72 to one of the plurality of wall anchors 71. Further, the inner inflatable anchor 72 is inflated with the roof 10 being attached in place.

As can be seen in FIG. 10, the wall anchor system 70 comprises an outer inflatable anchor 74, and a plurality of outer anchor connectors 75. Specifically, the outer inflatable anchor 74 is mounted within the rim 91 of the crater 90 and is terminally and peripherally positioned on the second gap 55 of the wall 50. Additionally, each of the plurality of outer anchor connectors 75 connects the outer inflatable anchor 74 to one of the plurality of wall anchors 71. The second gap 55 of the wall 50 is sealed with a sealant, and the outer inflatable anchor 74 is deflated. Further, the outer inflatable anchor 74 is inflated if a second roof is installed through traversing the second gap 55 of the wall 50 and being attached to the outer inflatable anchor 74. Both the inner inflatable anchor 72 and the outer inflatable anchor 74 include, but are not limited to, a tubular hollow ring or rod that may be inflated to a desired inner pressure. Once inflated, the inner inflatable anchor 72 and the outer inflatable anchor 74 each tucks below two layers of the wall 50 preventing the vertical movement of the inflatable structure 1 and provides a soft cushioning to the roof 10 and a uniform force distribution, preventing shear inflation forces inside the inflatable structure 1 from damage or tear. Additionally, the present invention provides a backup roof anchor system that comprises the outer wall 51, the second gap 55, the outer inflatable anchor 74, and the plurality of outer anchor connectors 75. This backup roof anchor system offers a "smart design" that allows the installation of an outer roof in parallel to the existing roof 10 without evacuating the residents and infrastructure inside the inflatable structure 1 of the present invention. For example, when the inflatable structure 1 needs replaced, maintained, and/or repaired due to damages, aging, wear and tear, etc., the existing roof 10 can be left intact while the backup roof anchor system can be used to efficiently and effectively construct an exterior roof exactly similar to the existing roof 10 that is still in place. Thus, the interior living environment of the inflatable structure 1 is maintained to avoid any disruption of internal activities.

Figure 2:
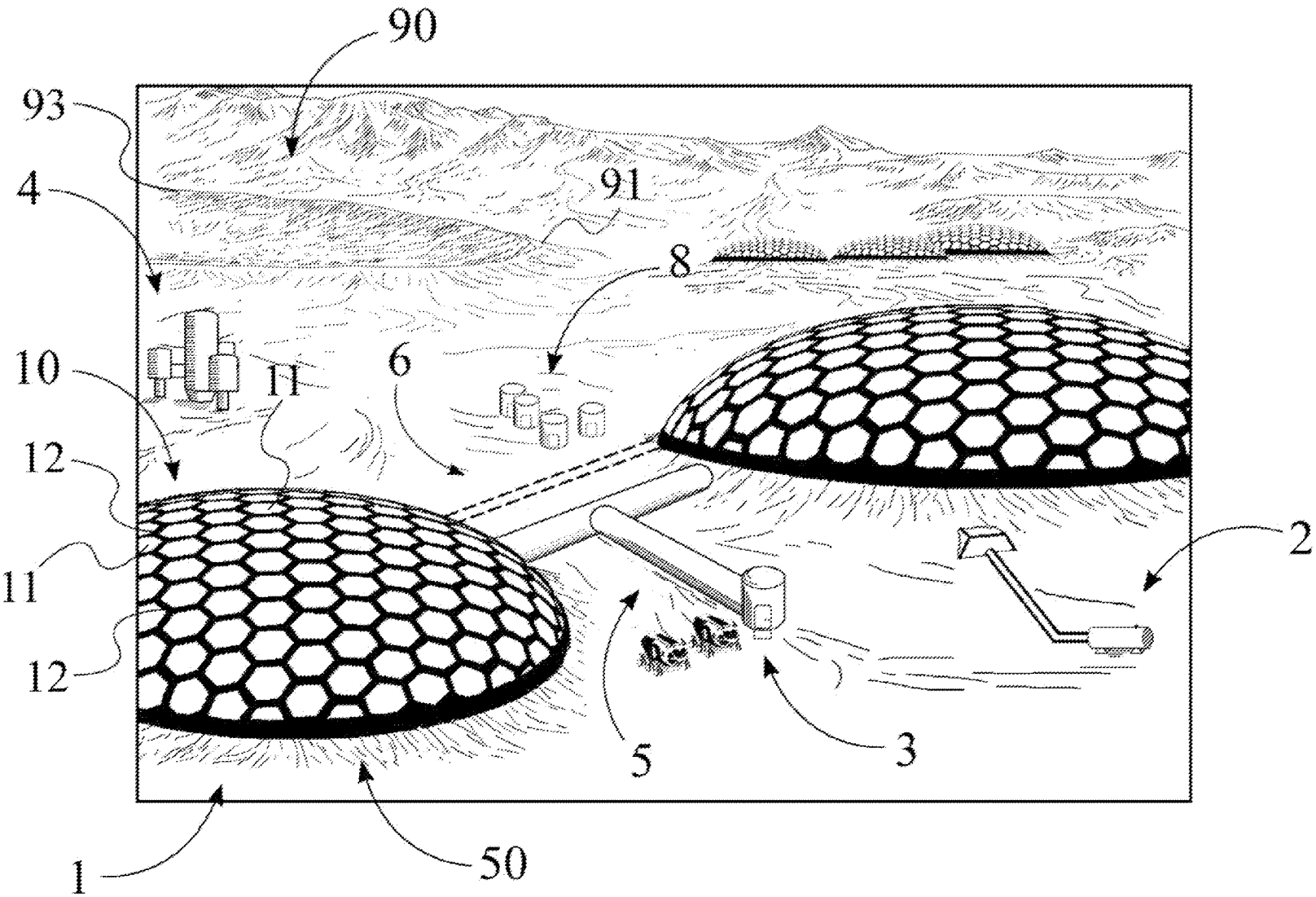
FIG. 2 is a front view of the inflatable habitat of the present invention.
Figure 3:
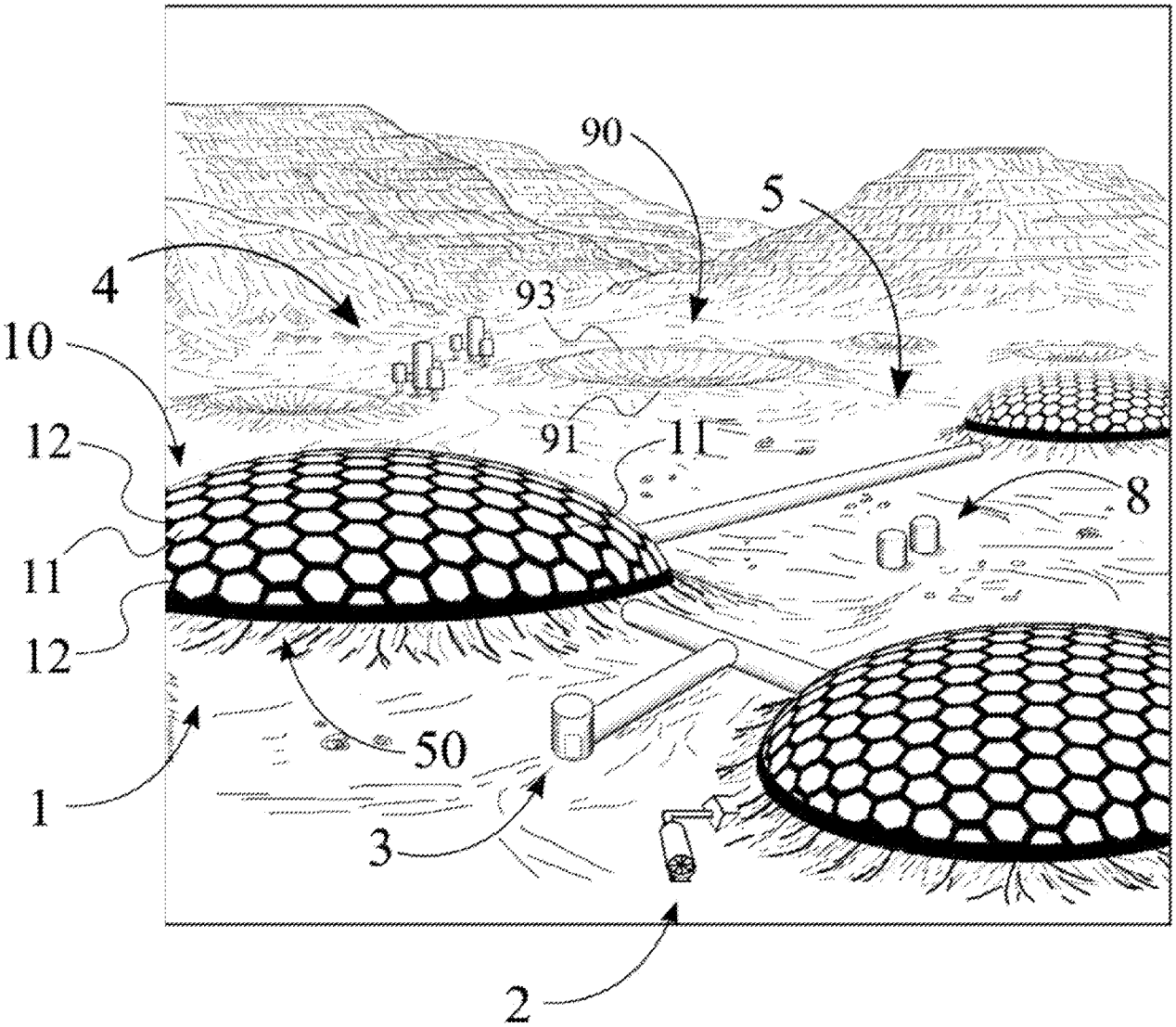
FIG. 3 is a top perspective view of the inflatable habitat of the present invention, wherein the inflatable habitat includes multiple inflatable structures, accessory equipment and systems, and preexisting craters.

As can be seen in FIG. 1 to FIG. 3, in other embodiments, the present invention may comprise at least one gas-turbine unit 2, at least one airlock system 3, at least one power plant 4, at least one surface tunnel 5, at least one underground tunnel 6, a solar power system, and at least one service module 8. Specifically, the at least one gas-turbine unit 2 is connected to the at least one inflatable structure 1, wherein the at least one gas-turbine unit 2 provides an interior atmosphere suitable for human habitation. The at least one airlock system 3 is connected to the at least one inflatable structure 1, wherein the at least one airlock system 3 provides a secure access to the at least one inflatable structure 1. The at least power plant 4 is connected to the at least one inflatable structure 1 to provide necessary electricity for the inflatable habitat of the present invention. The surface tunnel 5 is mounted on the ground of the inflatable habitat and is connected to the at least one inflatable structure 1 through the rim 91 of the crater 90. Similarly, the underground tunnel 6 is connected to the at least one inflatable structure 1. Additionally, the solar system 7 is electrically connected to the at least one inflatable structure 1 and provides clean energy to the inflatable habitat. Further, the service module 8 is positioned adjacent to the at least one inflatable structure 1 and provides various services including, but not limited to, water, air, waste, repair, maintenance services.

Overview:

A Craterhab (FIG. 1 to FIG. 5) consists of an inflatable structure composed of multiple layers of fabric built over craters, firmly secured along the crater rim and the floor of the crater through cables and anchors, and inflated using gas turbines and air compressors.

Advantages of Using Craters:

The Martian surface is full of impact craters, distributed almost everywhere. These range from smaller than a meter or so, to several hundred kilometers in diameter. Regions with clusters of craters ranging from 50 meters to several hundred meters in diameter can be used for creation of individual colonies of the Craterhabs. The advantage of using craters for creation of habitations is fourfold:

A. Using near-perfect circular shape of a crater for construction of circular habitats will require minimal engineering.

B. Utilizing the depth of craters as extra volume for habitats, thus requiring much less structural material for construction of domes as compared to a dome providing habitat volume on a flat surface. This also obviates the need for massive excavation for construction, as nature has done that for us during the formation of the craters.

C. Using crater rim for the construction of circular concrete reinforcements for the dome. Rim of an impact crater is formed as a result of the shockwave moving outwards immediately after a meteorite impact and is naturally more compact than the surrounding landscape. This fact is even more important in a Martian context where 38% of Earth's gravity means that the Martian soil is generally less compact as compared to that of Earth. Extra firmness of the crater rim can provide a significant advantage.

D. The inner slopes of a crater can be utilized as an interface for construction of the horizontal underground tunnel systems connecting individual Craterhabs while the outside slopes of the crater rim can act as interface for construction of surface tunnels and airlock systems for humans and other equipment such as transport, boring, mining and construction vehicles.

E. While habitats in craters have been discussed in the past including the book Mars Colonies by Frank Crossman (2020), which is a compilation of ideas by the contestants of 2019 competition for designing a human colony on Mars, our design of the Craterhab is fundamentally different from these designs. Dr. Robert Zubrin in his book The Case for Mars, has very briefly touched the concept of inflatable dome structures over small craters but questioned the feasibility of such an idea mainly owing to the distances between small craters which seems to make it impossible for establishing a cohesive colony solely made up of habitats in the craters. Detailed examination of Martian topography using high resolution satellite images of Mars such as Google Earth® (Mars) reveals that this is not entirely the case, and one can easily locate numerous clusters of small craters of diameters of a few hundred meters closely clumped together on flat landscapes.

Craterhab Structure:

The inflatable domes (Craterhabs) are composed of a skeleton of hexagonal or isogrid lattice frame of a super-strong yet lightweight fabric like Dyneema® or Kevlar®, and segments of Silicone-composite fabric layers (FIG. 7 to FIG. 8). Inside these Silicone-composite fabric segments (FIG. 6), translucent Kevlar can be used as composite material, impregnated with carbon-fiber to achieve superior strength. Fiberglass can be considered too for its lower cost and translucency but it is not as strong as Kevlar®. These fabrics are arranged in several layers to provide required strength yet enough translucency through silicone-composite patches to let in sufficient sunlight. The periphery of silicone composite fabric layers is sandwiched into the layers of the Dyneema® skeletal fabric lattice (FIG. 9). The composite fabric layers inside each silicone-composite fabric segment are interlocked with the Dyneema® skeletal cables running through the Dyneema® skeletal fabric frame (FIG. 8). The circumference of the dome comprises multiple layers of Dyneema® and continues through the circular fiber-reinforced concrete wall along the rim of the crater into the ground and secured to concrete anchors embedded several meters deep (FIG. 10). These concrete anchors have root-like appendages to increase the firm underground hold of the anchor, similar to weeds and plants which take a force of several times their own weight to be uprooted. Since the internal pressure of the Craterhab will impart several hundred-thousand tons of upward and outward force, this radicular anchor system plays a vital role in holding down the structure securely. Fabric layers of the peripheral section of the dome continue into an inflatable torus anchor (FIG. 10) beneath the sandwich wall along the entire periphery of the dome. This torus anchor has a connection to the interior of the habitat and is ballooned up with the same pressure as the internal environment, providing soft anchoring and cushioning to the sandwich wall and the dome itself and an even distribution of the shear forces. The multilayer fabric lining continues further down into a tether system and attaches to the system of embedded radicular concrete anchors as mentioned earlier.

In addition to the peripheral anchoring, each Craterhab will be secured to the underground through two sets of radial cables. This set of dual-radial internal cable system (FIG. 5) will secure the dome to a set of underground concrete anchors beneath the floor of the crater, similar to the anchors beneath the peripheral sandwich wall. This cable system will not only provide additional internal support to the main body of the dome, but will also minimize lateral movement of the dome in the event of Martian dust storms. Due to the fabric nature of the dome and the cable system, despite structural strength, the inherent flexibility of the fabric gives it necessary forgiveness and stress absorption capacity. This is a huge advantage of using this design and material over rigid structures on a large scale.

In contrast to the existing models for human habitation on Mars, including rigid surface structures and underground habitats, Mareekh Design® Craterhab Technology offers predominantly above-ground habitats of enormous volumes; the basic unit of which is the composite fabric inflatable dome structure or Craterhab.

Inflatable structure for human habitat is not a new idea. While validity of such structures has been discussed in many previous or current models such as Inflatable Habitation Volumes in Space (Taylor 2002)® and Transhab design[2], our Craterhab Technology is fundamentally different in its volume; offering sheer size of internal habitats spanning over volumes anywhere from few thousand to several million cubic meters.

The multilayer fabric lattice provides structural skeletal strength and anchoring to the Craterhab dome, while the translucent silicone-composite fabric layers provide thermal and UV (ultraviolet) protection while letting the visible and infrared light in, providing ambient light for human comfort and for growing plants.

Advantages of Craterhab:

The main purpose of a Craterhab is provision of large habitable volume, structural integrity and protection against the elements.

Maintenance of internal pressure: The atmospheric pressure on Mars is below 1% of that on Earth. Inflatable Craterhabs will provide pressurized internal habitable space. In order to maintain near-Earth like pressures inside a Craterhab (0.6-1.0 Bar), the dome needs to withstand an outward inflation pressure of 1 kg per square cm, or 10 tons per square meter. For a Craterhab of 300 meter diameter, this can be extrapolated to nearly a million tons of outward inflation pressure. An inflatable dome of composite material reinforced with multilayered woven fabric anchored to the rim of the crater through sandwich walls, and to the floor through reinforced dual-radial internal cable system as discussed earlier, is expected to withstand such an inflation pressure of at least 1 bar with a safety factor of many times more. This will ensure containment of internal habitable pressures thus ensuring long term habitability.

NASA's TransHab concept discusses the use of multilayered inflatable modules in space for provision of larger volumes of habitable space than that can be carried into space in a rocket payload bay. NASA JSC Mars TransHab idea proposes cylindrical habitat for transit to Mars and habitation modules for ISS. The factor common in most of these proposed designs, is their small pressurized volumes insufficient for long term human missions to Mars or its colonization where a shirt-sleeve environment with freedom of movement is not only essential for mental well-being of the occupants, but also necessary for logistical purposes and safety. The Craterhab Technology offers these solutions for enormous habitable volumes in Martian craters for long-term human habitation and colonization.

Protection from micro-meteors: While the Martian atmosphere is very thin, it is still thick enough to burn up the majority of very small meteors, leaving behind larger meteors which are far less numerous than the smallest of the ones. This is one of the major advantages of colonizing Mars in contrast to Earth's Moon where, due to complete lack of atmosphere, any surface units including rovers, habitats and astronauts are at risk from micrometer size meteors capable of punching through the armor and causing depressurization events.

A Craterhab is made up of fairly strong multi-layer composite material. The internal pressure of the habitats will provide a self-contained solution for repairing such defects caused by micro- or small sized meteors through the use of drones inside the Craterhabs to close the hole with repair patches which will be held by the internal inflation pressure against the ceiling of the dome while the glue takes hold. Such punctures can be easily detected from outside using infrared cameras detecting warm air whizzing out of the dome into the frigid Martian atmosphere.

Habitats composed of metal structure or glass are harder to be repaired in this manner. Ease of repairability offered by our composite-fabric Craterhab Technology is a major advantage in this regard.

Maintenance of internal temperature: Both Silicone and Kevlar are excellent insulators. The multilayer structure will offer additional thermal insulation.

Protection from radiation: Craterhabs have an inherent ability of significantly reducing Solar Ultraviolet (UV) rays which can be attributed to the Silicone used in its construction. Silicone can reflect up to 95% of Solar UV radiation. This is comparable to 90% reflectivity of Earth's atmosphere. In addition to this, Craterhab Technology also offers provision of a powered radiation shield incorporated into the body of the Craterhab itself, called Active Integrated Radiation Shield (AIRS).

Actively Integrated Radiation Shield (AIRS):

Many contemporary models of human habitation on Mars propose several meters thick layers of either water or regolith on top of the habitats, or building the habitats underground several meters below the surface. Though a direct solution it may seem, for long term, it will be severely limited by the ever-growing size of human habitats. Living under hundreds or thousands of tons of shielding in the form of regolith or water poses a constant threat to the safety of the occupants and may even risk structural failure with disastrous consequences.

Craterhab Technology provides protection against Solar radiation through its Active Integrated Radiation Shield (AIRS) using power cables running through the skeletal fabric frame of the inflated dome (FIG. 11) carrying a Direct Current (DC). Few kilowatts of power may be required to generate a non-ionizing electromagnetic field matching Earth's magnetic field at a very small scale for a crater of roughly 300 meters in diameter, sufficient enough to deflect a significant fraction of solar or cosmic radiation and thus preventing it from penetrating into the habitable spaces (FIG. 11). However, in order to ensure a safety factor, few tens of kilowatts of power per Craterhab may be required. The non-ionizing radiation of the active radiation shield may have a downside of potentially interfering with the electronics inside the Craterhab if the generated magnetic field is higher than that of Earth's magnetosphere. This interference can be minimized through the use of carbon-fiber impregnated mesh into the inner layers of fabric material in the dome acting like a Faraday's Cage. This active radiation shield can obviate the need for the costly infrastructure of creating heavy and risky water or regolith shielding above the surface habitable spaces.

In-situ provision of an artificial magnetic shield is not a new idea. It has been extensively discussed to provide protection of astronauts especially outside Earth's magnetic sphere, for example when travelling to Mars and beyond. NASA has discussed Space Radiation Superconducting Shield (SR2S) in its Innovative Advanced Concepts program (NIAC)[3], using Magnetospheric Dipolar Torus (MDT). NIAC proposed extrapolation of this concept for long term use on the surface of Mars to shield human habitats against solar and cosmic radiation. Magnetic torus idea may not be effective on large scale enormous sized habitats such as Craterhabs as it is more effective in offering protection in tunnel or doughnut shaped habitats.

In further embodiments, an inflatable habitat unit (Craterhab) is disclosed. Further, the Craterhab may include an inflatable multilayer fabric dome, with multilayer hexagon or isogrid skeletal lattice of Dyneema® or Kevlar® to provide structural strength, and multilayer Silicone composite fabric segments to provide structural strength as well as translucency and thermal insulation. Further, the Craterhab may include a peripheral concrete sandwich wall along the rim of crater through which the fabric dome will be secured to the embedded concrete anchors, and the dome roof secured through Dyneema® cable system to the anchors embedded in the floor of the crater.

Further, in some embodiments, the Craterhab may make use of Martian craters for the construction of habitats utilizing their near-perfect circular shape and compactness of their rims for installing inflatable domes over the craters. Further, the Craterhab may be configured for utilizing the depth of the craters as an additional habitable volume for the same amount of fabric as needed for a dome on a flat surface of a similar area. Further, the Craterhab may be configured for making use of the internal and external slopes of the crater as an interface for the construction of underground or overground tunnels and airlock systems.

Although the invention has been explained in relation to its preferred embodiment, it is to be understood that many other possible modifications and variations can be made without departing from the spirit and scope of the invention as hereinafter claimed.

What is claimed is:

1. An inflatable habitat for human settlement in an environment with a gas pressure below the earth's atmospheric pressure comprising:

at least one inflatable structure;

the inflatable structure comprising a crater, a roof, a wall, and a wall anchor system;

the crater comprising a rim, a floor, an opening, and a plurality of internal anchors;

the rim being peripherally positioned on the opening;

the floor being positioned on the bottom of the rim opposite the opening;

the plurality of internal anchors being interiorly mounted into the floor;

the roof comprising a plurality of roof segments, a plurality of roof skeletal frames, and a plurality of internal roof connectors;

the plurality of roof segments being distributed across the roof;

each of the plurality of roof segments being peripherally attached to least one of the plurality of roof skeletal frames;

each of the plurality of internal roof connectors being connected to at least one of the plurality of roof skeletal frames and one of the plurality of internal anchors of the crater;

the roof being terminally and peripherally attached to the wall;

the wall anchor system comprising a plurality of wall anchors;

the plurality of wall anchors being distributed underground;

the plurality of wall anchors being positioned beneath the rim of the crater;

the wall being mounted to the rim; and the wall being attached to the plurality of wall anchors of the wall anchor system.

2. The inflatable habitat for human settlement in an environment with a gas pressure below the earth's atmospheric pressure as claimed in claim 1, wherein:

the inflatable structure comprises a magnetic shield system;

the magnetic shield system comprises a plurality of power cables each of the plurality of power cables is interconnected with an arbitrary one thereof;

the plurality of power cables is externally positioned on the roof; and wherein the plurality of power cables generates a magnetic field enclosing the exterior of the roof when a DC (direct current) electric power is supplied to the plurality of power cables.

3. The inflatable habitat for human settlement in an environment with a gas pressure below the earth's atmospheric pressure as claimed in claim 2, wherein:

each of the plurality of power cables is positioned on one of the roof skeletal frames of the roof;

the magnetic shield system comprises a plurality of main power cables, and an AC (alternate current) to DC power converter;

the AC to DC power converter is electrically connected with an extraneous power source through one of the plurality of main power cables;

the AC to DC power converter is electrically connected with the plurality of power cables of the roof skeletal frames through one of the plurality of main power cables; and wherein the magnetic field is generated by the plurality of power cables with the DC flowing through thereof.

4. The inflatable habitat for human settlement in an environment with a gas pressure below the earth's atmospheric pressure as claimed in claim 1, wherein:

each of the plurality of roof segments comprises an upper segment and a lower segment;

the lower segment is positioned on the roof facing the opening of the crater; and the upper segment is positioned on the roof opposite the lower segment.

5. The inflatable habitat for human settlement in an environment with a gas pressure below the earth's atmospheric pressure as claimed in claim 4, wherein:

each of the plurality of roof skeletal frames comprises an upper frame and a lower frame;

the upper segment of each of the plurality of roof segments is attached to the upper frame of one of the plurality of roof skeletal frames; and the lower segment of each of the plurality of roof segments is attached to the lower frame of one of the plurality of roof skeletal frames.

6. The inflatable habitat for human settlement in an environment with a gas pressure below the earth's atmospheric pressure as claimed in claim 5, wherein:

the upper segment and the lower segment each comprises a composite segment;

the composite segment comprises a first layer, a core layer, and a second layer;

the second layer is positioned on the plurality of roof segments facing the opening of the crater;

the core layer is attached to the second layer opposite the opening of the crater; and the first layer is attached to the core layer opposite the second layer.

7. The inflatable habitat for human settlement in an environment with a gas pressure below the earth's atmospheric pressure as claimed in claim 6, wherein:

the composite segment comprises a plurality of interlocking tabs;

the plurality of interlocking tabs is terminally and peripherally distributed on the composite segment; and each of the plurality of interlocking tabs is attached to one of the plurality of roof skeletal frames.

8. The inflatable habitat for human settlement in an environment with a gas pressure below the earth's atmospheric pressure as claimed in claim 5, wherein:

the lower frame comprises a roof anchor; and the roof anchor is attached to one of the plurality of internal roof connectors.

9. The inflatable habitat for human settlement in an environment with a gas pressure below the earth's atmospheric pressure as claimed in claim 1, wherein:

the plurality of internal anchors comprises a plurality of proximal anchors and a plurality of distal anchors;

the plurality of distal anchors is peripherally positioned inside the floor;

the plurality of proximal anchors is positioned inside the floor adjacent the center of the floor;

the plurality of roof skeletal frames comprises a plurality of distal frames and a plurality of proximal frames;

the plurality of distal frames is peripherally positioned on the roof;

the plurality of proximal frames is positioned on the roof adjacent the center of the roof;

each of the plurality of proximal frames of the plurality of roof skeletal frames is connected to one of the plurality of distal anchors of the plurality of internal anchors through one of the plurality of internal anchor connectors; and each of the plurality of distal frames of the plurality of roof skeletal frames is connected to one of the plurality of proximal anchors of the plurality of internal anchors through one of the plurality of internal roof connectors.

10. The inflatable habitat for human settlement in an environment with a gas pressure below the earth's atmospheric pressure as claimed in claim 1, wherein:

the wall comprises an outer wall, a middle wall, an inner wall, a first gap, and a second gap;

the inner wall is mounted to the rim of the crater;

the inner wall is peripherally positioned on the opening of the crater;

the middle wall is mounted to the rim of the crater adjacent the inner wall opposite the opening;

the outer wall is mounted to the rim of the crater adjacent the middle wall;

the first gap is positioned between the inner wall and the middle wall; and the second gap is positioned between the middle wall and the outer wall.

11. The inflatable habitat for human settlement in an environment with a gas pressure below the earth's atmospheric pressure as claimed in claim 10, wherein:

the wall anchor system comprises an inner inflatable anchor, and a plurality of inner anchor connectors;

the inner inflatable anchor is mounted within the rim of the crater;

the inner inflatable anchor is terminally and peripherally positioned on the first gap of the wall;

the roof traverses through the first gap of the wall;

the roof is terminally and peripherally attached to the inner inflatable anchor; and each of the plurality of inner anchor connectors connects the inner inflatable anchor to one of the plurality of wall anchors.

12. The inflatable habitat for human settlement in an environment with a gas pressure below the earth's atmospheric pressure as claimed in claim 11, wherein the inner inflatable anchor is inflated.

13. The inflatable habitat for human settlement in an environment with a gas pressure below the earth's atmospheric pressure as claimed in claim 10, wherein:

the wall anchor system comprises an outer inflatable anchor, and a plurality of outer anchor connectors;

the outer inflatable anchor is mounted within the rim of the crater;

the outer inflatable anchor is terminally and peripherally positioned on the second gap of the wall;

each of the plurality of outer anchor connectors connects the outer inflatable anchor to one of the plurality of wall anchors of the wall;

the second gap is sealed with a sealant; and the outer inflatable anchor is deflated.

14. The inflatable habitat for human settlement in an environment with a gas pressure below the earth's atmospheric pressure as claimed in claim 13, wherein the outer inflatable anchor is inflated if a second roof is installed through traversing the second gap of the wall and being attached to the outer inflatable anchor.

15. The inflatable habitat for human settlement in an environment with a gas pressure below the earth's atmospheric pressure as claimed in claim 1, wherein the plurality of roof segments is translucent.

16. The inflatable habitat for human settlement in an environment with a gas pressure below the earth's atmospheric pressure as claimed in claim 1, wherein each of the plurality of roof segments forms a repeating hexagonal lattice pattern.

17. The inflatable habitat for human settlement in an environment with a gas pressure below the earth's atmospheric pressure as claimed in claim 1, wherein each of the plurality of roof segments forms an isogrid lattice pattern.

18. The inflatable habitat for human settlement in an environment with a gas pressure below the earth's atmospheric pressure as claimed in claim 1, wherein the inflatable structure comprises a dome structure.

19. The inflatable habitat for human settlement in an environment with a gas pressure below the earth's atmospheric pressure as claimed in claim 1 comprising:

at least one surface tunnel;

the surface tunnel being mounted on the ground of the inflatable habitat; and the surface tunnel being connected to the at least one inflatable structure through the rim of the crater.

20. The inflatable habitat for human settlement in an environment with a gas pressure below the earth's atmospheric pressure as claimed in claim 1 comprising:

at least one underground tunnel; and the underground tunnel being connected to the at least one inflatable structure.

* * * * *